United States Patent [19]

Fischer

[11] Patent Number: 4,895,595

[45] Date of Patent: Jan. 23, 1990

[54] DIRECT SMELTING PROCESS FOR NON-FERROUS METAL SULFIDE ORES

[75] Inventor: Peter Fischer, Bad Vilbel, Fed. Rep. of Germany

[73] Assignee: Metallgesellschaft Aktiengesellschaft, Frankfurt am Main, Fed. Rep. of Germany

[21] Appl. No.: 146,768

[22] Filed: Jan. 22, 1988

[30] Foreign Application Priority Data

Jan. 23, 1987 [DE] Fed. Rep. of Germany ..... 3701846

[51] Int. Cl.[4] ..... C22B 13/00

[52] U.S. Cl. ..... 75/62; 75/21; 75/77; 75/88; 75/92

[58] Field of Search ..... 75/21, 23, 92, 62, 77, 75/72, 88

[56] References Cited

U.S. PATENT DOCUMENTS 2,769,706 11/1956 Herneryd et al. ..... 75/72
4,252,560 2/1981 Vanjukov et al. ..... 75/21
4,414,022 11/1983 Melcher ..... 75/26

FOREIGN PATENT DOCUMENTS 747352 9/1944 Fed. Rep. of Germany .
3539164 4/1987 Fed. Rep. of Germany ..... 75/62

*Primary Examiner*—Melvyn J. Andrews
*Attorney, Agent, or Firm*—Sprung Horn Kramer & Woods

[57] ABSTRACT

Smelting is effected in a reactor containing juxtaposed oxidizing and reducing zones. The slag baths in the two zones communicate with each other. The slag baths of the two zones communicate with each other, the materials are charged into the slag bath in the oxidizing zone and oxygen-containing gases are blown into the slag bath in the oxidizing zone, a slag which is rich in non-ferrous metal oxides is passed from the oxidizing zone into the reducing zone, reducing agent and oxygen-containing gases are blown into the slag in the reducing zone at such respective rates that the non-ferrous metal oxides are substantially completely reduced and a phase that is rich in non-ferrous metal is formed, a slag which is poor in non-ferrous metal is tapped from the reducing zone, gases are separately sucked from the oxidizing and reducing zones, and the subatmospheric pressures in the suction lines connected to the oxidizing and reducing zones are so controlled that a zero differential pressure is obtained adjacent to the boundary between the oxidizing and reducing zones.

7 Claims, 1 Drawing Sheet

DIRECT SMELTING PROCESS FOR NON-FERROUS METAL SULFIDE ORES

DESCRIPTION

This invention relates to a continuous process of directly smelting materials which contain non-ferrous metal sulfides.

In the direct smelting of materials which contain non-ferrous metal sulfides, such as concentrates or ores of lead, copper, zinc, nickel, cobalt, or mixtures thereof, a roasting reduction and smelting are effected at the same time in a reactor to produce either the metal or a matte.

Such process is known from U.S. Pat. No. 3,941,587. A horizontal elongate reactor contains molten material consisting of a slag phase and a phase which is rich in non-ferrous metal. The reactor contains an oxidizing zone and a reducing zone and is provided with nozzles for blowing oxygen-containing gases into the molten material. The charge is fed to the molten bath in the oxidizing zone and is oxidized therein by the oxygen which is supplied. The resulting slag, which is rich in non-ferrous metal oxide, flows into the reducing zone, in which carbonaceous reducing agents are blown into the molten material. The reduced metal is included in a phase which is rich in non-ferrous metal and flows into the oxidizing zone. The slag phase which is poor in non-ferrous metal is withdrawn at the end of the reducing zone. The phase which is rich in non-ferrous metal is withdrawn at the beginning of the oxidizing zone. If matte rather than metal is to be produced, a sulfur-containing substance, such as $SO_2$, will be introduced into the molten bath in the reducing zone. The exhaust gas is withdrawn at the end of the reducing zone. Carbonaceous material can be blown into the slag before it is withdrawn so that non-ferrous metals, such as zinc and lead, will be volatilized and will be entrained by the exhaust gas to be discharged from the reactor and may subsequently be collected from the exhaust gas.

U.S. Pat. No. 4,266,971 discloses a modification of that process, in which the exhaust gas is conducted opposite to the direction of flow of the slag phase and is withdrawn at the beginning of the oxidizing zone.

Canadian Patent Specification No. 893,624 discloses a process of directly smelting lead sulfides, in which lead sulfides are gradually oxidized in the oxidizing zone to form molten lead. The slag, which has a relatively low lead content, is treated in the reducing zone with blown-in hydrocarbons so that the zinc content is substantially volatilized and is removed from the reactor together with the exhaust gas. The metallic lead is tapped from an intermediate zone of the reactor between the oxidizing and reducing zones. The exhaust gas is withdrawn approximately at the end of the oxidizing zone.

In said processes, the exhaust gases from the oxidizing and reducing zones are jointly withdrawn.

British Patent Specification No. 1,351,999 discloses a process for a recovery of metals of high purity in steps which are either performed in separate reactors, which are interconnected for the flow of the molten material, or in an elongate reactor, in which the gas space over the molten material is divided by partitions into different zones, from which the exhaust gases are separately withdrawn. In the processing of sulfide ores, the $SO_2$-containing gases are withdrawn from the oxidizing smelting zone separately from the gases of the succeeding processing zone.

It is known from Publishing German Application No. 36 11 159 to process particularly zinc sulfide concentrates in a horizontal reactor in which the gas space is decided between the oxidizing and reducing zones by a partition. The exhaust gas from the oxidizing zone is withdrawn at the beginning of the oxidizing zone. The exhaust gas from the reducing zone is withdrawn from the first part of the reducing zone. A slag bath which contains the metal content of the charge as metal oxides is formed in the oxidizing zone and flows under the partition into the reducing zone, where coal is introduced into the slag bath and the metal oxides are reduced. Zinc and lead are evaporated and collected from the exhaust gas.

In the two processes mentioned last, the $SO_2$-containing gas from the oxidizing zone and the $SO_2$-free gas from the reducing zone are separately withdrawn. But the partition does not permit gas from one zone to be withdrawn through the other zone. As a result, it is not possible to repair or inspect the gas outlet of a given zone or equipment which succeeds said gas outlet unless that zone is cooled. Besides, the partition will also prevent a flow of slag from the oxidizing zone into the reducing zone if the flow under the partition is disturbed. Moreover, the partition prevents a transfer of volatilized metals into a given zone from the adjacent portion of the other zone.

It is an object of the invention to provide such a process of directly smelting sulfide materials in which the exhaust gases from the oxidizing and reducing zones can be substantially separately withdrawn, the adjacent portions of the oxidizing and reducing zones can be interconnected on the gas side and an emergency discharge of slag from the oxidizing zone and a withdrawal of flue gas from either zone through the other will be permitted.

That object is accomplished in accordance with the invention in that: (a) smelting is effected in a reactor containing juxtaposed oxidizing and reducing zones, (b) the slag baths of the two zones communicate with each other, (c) in the materials are charged into the slag bath in the oxidizing zone and oxygen-containing gases are blown into the slag bath in the oxidizing zone, (d) a slag which is rich in non-ferrous metal oxides is passed from the oxidizing zone into the reducing zone, (e) reducing agent and oxygen-containing gases are blown into the slag in the reducing zone at such respective rates that the non-ferrous metal oxides are substantially completely reduced and a phase that is rich in non-ferrous metal is formed, (f) a slag which is poor in non-ferrous metal is tapped from the reducing zone, (g) gases are separately sucked from the oxidizing and reducing zones, and (h) the subatmospheric pressures in the suction lines connected to the oxidizing and reducing zones are so controlled that a zero differential pressure is obtained adjacent to the boundary between the oxidizing and reducing zones.

The oxidizing zone may be operated in such a manner that only a slag phase is formed therein which contains the entire non-ferrous metal content in the form of oxides. Alternatively, the oxidizing zone can be operated to form a slag phase and a phase which is rich in non-ferrous metal. In that case the slag will contain only part of the non-ferrous metal contents in the form of oxides. The phase which is rich in non-ferrous metal may consist of metal, such as lead, or of matte, such as copper matte. Oxygen-enriched air or technically pure oxygen are used as oxygen-containing gases. The reducing agents supplied to the reducing zone may be solid, gaseous or liquid. The phase which has been formed in the reducing zone and is rich in non-ferrous metal can be tapped from the oxidizing zone at any point thereof, from the beginning to the end, or at the beginning of the reducing zone. The slag is withdrawn at the end of the reducing zone. The flowing of the oxygen-containing gases and of the reducing agents into the molten material is preferably effected in known manner through nozzles comprising a plurality of concentric tubes. The nozzles are protected against oxidation in that a coolant is blown into the molten material at the same time. The exhaust gases are preferably sucked from each zone at the beginning of the oxidizing zone and at the end of the reducing zone or may be sucked from each zone at any other point. If the mutually adjacent portions of the two zones are to be interconnected on the gas side for metallurgical reasons, the location of the zero pressure differential will be shifted as is required. In that case it is possible to effect a separation, e.g., of a non-ferrous metal which is reduced and volatilized at a higher oxidation potential from a non-ferrous metal which is reduced and volatilized at a lower oxidation potential. For instance, the slag may initially be selectively reduced to lead at the beginning of the reducing zone so that part of the lead content of the slag becomes available as vapor and is sucked into the oxidizing zone by a suitable control of the subatmospheric pressure therein. The slag in the reducing zone can subsequently be reduced to zinc, which becomes available as a vapor having a very low lead content and is separately sucked from the reducing zone. A plurality of oxidizing zones and/or a plurality of reducing zones may be connected in series. In the production of a matte, such as copper matte, as a phase which is rich in non-ferrous metal, a reducing agent consisting of a sulfide or $SO_2$ will be used in the reducing zone together with another reducing agent. The reactor can be rotated about its axis to move the nozzles out of the molten material.

In accordance with a preferred feature the cross-section of the gas space in the reactor is constricted at the boundary between the oxidizing and reducing zones. The term "constricted" is intended to cover any reduction of the cross-section of the gas space which leaves an opening in the gas space above the surface of the molten material. The opening may be disposed at the center of the cross-section or may be laterally disposed. Whereas only one opening will usually be employed, a plurality of openings may be provided. The constriction is suitably defined by a wall which has a gas passage opening. That wall will extend into the molten material and will leave below the wall an underflow passage for the molten material. The provision of the constriction will facilitate the control of the location where a zero differential pressure occurs.

In accordance with a further preferred feature the gas flow area of the constriction is disposed closely over the surface of the slag bath. This will ensure that the slag will soon flow from the oxidizing zone into the reducing zone in case of a disturbance of the slag flow under the constricting means. That early beginning of the overflow will prevent in the oxidizing zone a formation of a higher slag layer resulting in an appreciably higher static pressure.

In accordance with a preferred feature a dam having a passage opening for the slag is provided in the slag bath at the boundary between the oxidizing and reducing zones. The dam preferably consists of a partition, which defines an opening at its lower end or has a slot at its center. The dam suitably constitutes a unit with the partition provided in the gas space. The dam will facilitate the metallurgical processing in the oxidizing and reducing zones.

In accordance with a preferred feature the dam is formed with a passage opening for the phase which is rich in non-ferrous metal and for the slag. A common opening for the metal phase and the slag phase will afford the advantage that the metal phase, which melts at a lower temperature, will always ensure that the opening remains open so that slag can flow through the opening. Besides, the primary metal phase produced in the oxidizing zone can be withdrawn together with a secondary metal phase, which has been formed in the reducing zone.

In accordance with a preferred feature, at least part of the reducing zone of the reactor is smaller in diameter than the oxidizing zone. This will promote the flow of the slag from the oxidizing zone into the reducing zone and of the molten phase which is rich in non-ferrous metal from the reducing zone into the oxidizing zone whereas the refractory linings in the two zones need not differ in thickness. In that case the beginning of the reducing zone is disposed in the final portion of that portion of the reactor which is larger in diameter because this will ensure that a metal bath will always be maintained in the underflow opening under the dam.

In accordance with a preferred feature the gas flow area of the constriction has such an area that flue gases flowing through will have a gas velocity below 15 m/sec., preferably of 4 to 8 m/sec.. When a repair or inspection is necessary at one of the two gas outlets or the units succeeding the same, the molten material will be maintained in a liquid state by a supply of heat and the resulting flue gases will be discharged through the other gas outlet so that it is not necessary to empty the reactor and to permit the lining to cool down. A holding at an elevated temperature can very effectively be achieved at that gas velocity.

The invention will be explained more in detail with reference to the drawing.

Figure 1:
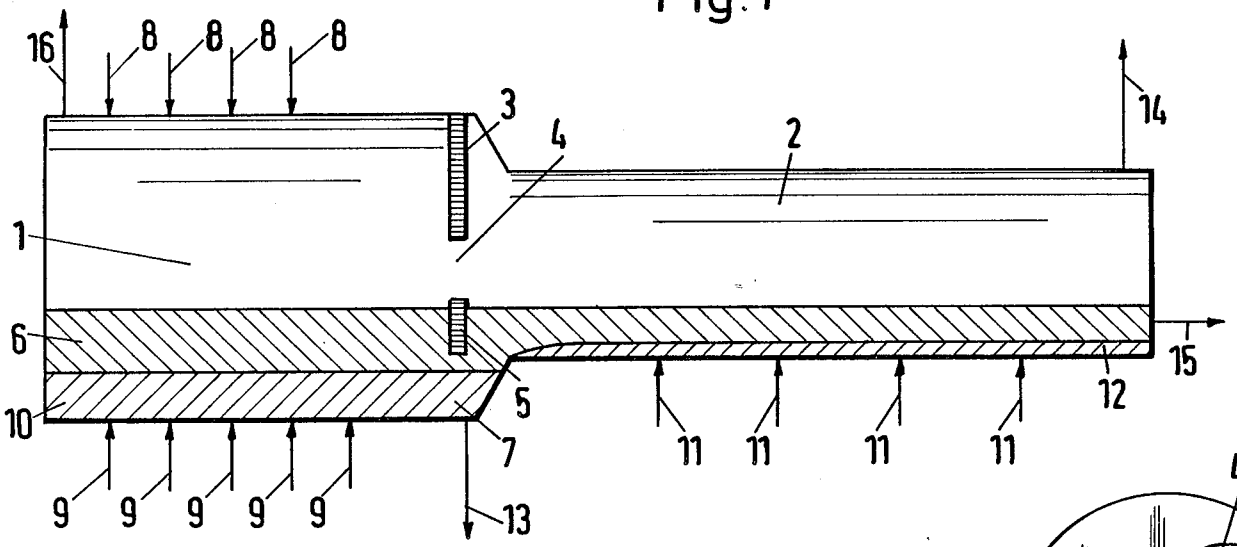
FIG. 1 is a longitudinal sectional view showing a reactor having a constriction.
Figure 2:
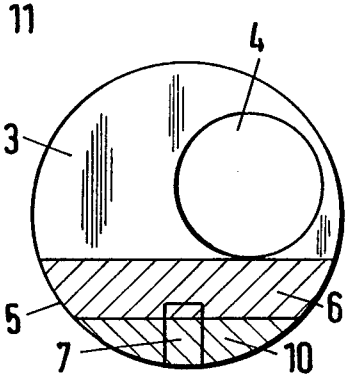
FIG. 2 is an embodiment of the constricting means (combined in a unit with a dam in) the slag layer.

In accordance with FIG. 1 a wall 3 formed with a gas passage opening 4 is disposed as constricting means in the gas space at the boundary between the oxidizing zone 1 and reducing zone 2. The wall 3 constitutes also a dam 5 in the slag layer 6. The bottom edge of the gas passage opening 4 is disposed closely over the surface of the slag layer 6. The bottom edge of the dam 5 defines a passage opening 7 having a top edge that is disposed in the slag layer 6 so that the slag can flow through the passage opening 7. In the oxidizing zone 1 the charge is supplied onto the molten material through a plurality of feeders 8 and oxygen 9 is injected from below. A slag phase 6 is formed, which has a high content of non-ferrous metal oxide, and a primary phase 10 is formed, which is rich in non-ferrous metal. The slag phase 6 flows through the passage opening 7 into the reducing zone 2, in which oxygen and reducing agent 11 are injected from below, the non-ferrous metal oxide content of the slag is reduced and a liquid secondary phase 12 is formed, which is rich in non-ferrous metal and flows toward the oxidizing zone 1. The primary and secondary phases 10 and 12 which are rich in non-ferrous metal are withdrawn together at 13. A second phase which is rich in non-ferrous metal may be formed in the reducing zone in the form of volatilized non-ferrous metals and withdrawn with the exhaust gas 14, which is free of $SO_2$. The slag which is poor in non-ferrous metal is withdrawn at 15. The $SO_2$-containing exhaust gas is withdrawn from the oxidizing zone 1 at 16.

The advantages afforded by the invention reside in that the adjacent portions of the oxidizing and reducing zones can communicate with each other on the gas side in spite of the fact that the gases are separately withdrawn from said zones. As a result, vaporized metals may be withdrawn in case of need through a given zone from the adjacent portion of the other zone so that the process can be carried out in a versatile manner. Moreover, flue gases from one zone may be conducted through the other zone so that the gas outlet of either zone or suceeding equipment may be repaired or inspected without a need for a cooling of the lining or of the molten material. Besides, even in case of a disturbance the slag from the oxidizing zone can always flow into the reducing zone.

I claim:

1. A continuous process of directly smelting a material which contains a non-ferrous metal sulfide, comprising (a) smelting in a reactor having a wall separating it into spaced oxidizing and reducing zones each with a slag bath, the reactor further having a gas space and suction lines connected to said oxidizing and reducing zones, (b) the slag baths of the two zones communicating with each other, (c) charging material containing a non-ferrous metal sulfide to be smelted into the slag bath in the oxidizing zone and blowing an oxygen-containing gas into the slag bath in the oxidizing zone, (d) passing a slag rich in an oxide of the non-ferrous metal of the non-ferrous metal sulfide from the oxidizing zone into the reducing zone, (e) blowing a reducing agent and oxygen-containing gas into the slag in the reducing zone at such respective rates that the non-ferrous metal oxides are substantially completely reduced and a phase that is rich in non-ferrous metal is formed, (f) tapping a slag which is poor in non-ferrous metal from the reducing zone, (g) separately sucking from the oxidizing and reducing zones gases generated therein through said suction lines, and (h) controlling the pressures in the suction lines connected to the oxidizing and reducing zones so that a zero differential pressure is obtained adjacent to the space between the oxidizing and reducing zones, the gas space in the reactor having a cross-section which forms a constriction between the oxidizing and reducing zones, and a flow area of the constriction being disposed closely over a surface of the slag bath, a lower part of the constriction reaching into the slag bath but leaving open a passage for slag.

2. A process according to claim 1, wherein the wall forms a dam having a slag passage opening in the slag bath at the boundary between the oxidizing and reducing zones.

3. A process according to claim 2, wherein the dam is formed with a passage for the phase which is rich in non-ferrous metal and for the slag.

4. A process according to claim 1, wherein at least a portion of the reducing zone of the reactor has a diameter which is smaller than the diameter of the oxidizing zone.

5. A process according to claim 1, wherein the flow area of the constriction has an area such that flue gases flowing therethrough will have a gas velocity below 15 m/sec.

6. A process according to claim 1, wherein the flow area of the constriction has an area such that flue gases flowing therethrough will have a gas velocity of about 4 to 8 m/sec.

7. A process according to claim 1, wherein the material being smelted contains lead and zinc, the product comprising lead, zinc being volatilized in the reducing zone.

* * * * *